US005649883A

United States Patent [19]

Mayes et al.

[11] Patent Number: 5,649,883

[45] Date of Patent: Jul. 22, 1997

[54] RACER WHEELCHAIR TRAINER

[75] Inventors: Douglas Mayes, Los Angeles; Jerome M. Burak, Chatsworth, both of Calif.

[73] Assignee: D & J Development Workshop, Inc., Van Nuys, Calif.

[21] Appl. No.: 595,298

[22] Filed: Feb. 1, 1996

[51] Int. Cl.[6] ..... A63B 22/02

[52] U.S. Cl. ..... 482/54; 482/904

[58] Field of Search ..... 482/54, 51, 57, 482/61, 904

[56] References Cited

U.S. PATENT DOCUMENTS

| | | |
|---|---|---|
| 4,233,844 | 11/1980 | Dreisinger et al. . |
| 4,441,705 | 4/1984 | Brown . |
| 4,500,102 | 2/1985 | Haury et al. . |
| 4,705,448 | 11/1987 | Mungons . |
| 4,846,156 | 7/1989 | Kopnicky . |
| 4,911,425 | 3/1990 | Kynast et al. . |
| 4,966,362 | 10/1990 | Ramaekers . |
| 5,163,885 | 11/1992 | Wanzer et al. . |
| 5,197,558 | 3/1993 | Misawa . |
| 5,333,894 | 8/1994 | Mayes . |
| 5,383,830 | 1/1995 | Shu . |

FOREIGN PATENT DOCUMENTS

| | | |
|---|---|---|
| 2534806 | 4/1984 | France . |

OTHER PUBLICATIONS

Freeman, "Coach Extraordinaire", *Sports 'N Spokes* (Magazine), V. 29, N. 1, May/Jun. 1994, pp. 20–24.

Eagle Sportschairs, Pro–Roller Advertisement, *Sports 'N Spokes* (Magazine), V. 20, N. 1, May/Jun. 1994, p. 62.

D & J Development, Training Rollers Advertisement, *Sports 'N Spokes* (Magazine), V. 20, N. 1, May/Jun. 1994, p. 66.

Mclain Cycle Products, "The Bug Roller" Advertisement, *Sports 'N Spokes* (Magazine), V. 20, N. 1, May/Jun. 1994, p. 86.

Racermate, Computrainer Operating Manual (1994).

*Primary Examiner*—Lynne A. Reichard
*Attorney, Agent, or Firm*—David Weiss

[57] ABSTRACT

Wheelchair trainer apparatus for use with a three-wheel racer wheelchair and which may be effectively utilized as part of a computerized system for physiological training and simulated road race training. A jack supports the wheelchair frame such that the drive wheels just make frictional driving contact with the crest of one of two of the trainer's rollers. Undesired drag, caused by the weight of the wheelchair and its user, is substantially decreased or virtually eliminated, enhancing the trainer's ability to simulate real road conditions.

10 Claims, 3 Drawing Sheets

RACER WHEELCHAIR TRAINER

BACKGROUND OF THE INVENTION

This invention relates to apparatus for the fitness and sports training of wheelchair users, and more particularly to three-wheel racer wheelchair support apparatus for permitting more effective workouts and better utilization of the trainer's computerized features.

Wheelchairs are commonly used by physically disabled persons both for everyday transportation and for participating in sports activities such as road racing, basketball and tennis. One type of wheelchair, known as a "racer" wheelchair and used for competition road racing, includes a frame to which two large rear wheels are rotatably mounted for being hand-driven by the user, one on each side of the frame for supporting the frame along with one generally smaller front wheel. An example of such a three-wheel racer wheelchair is shown in U.S. Pat. No. 5,333,894 to Mayes, which patent is incorporated herein by this reference.

Physiological training of the racer wheelchair user, for rehabilitation, fitness and proficiency in road racing, has been implemented in the past by various exerciser or trainer devices. In one type of trainer, a pair of rollers are rotatably mounted in a frame with their rotational axes parallel to each other and spaced to cradle the wheelchair's two rear drive wheels. The wheelchair is driven up a ramp, and the rear wheels are rolled into the roller cradle and hand driven by the wheelchair user to drive the rollers in which the wheels are cradled. It has been experienced that the contact of the rubber tires at the periphery of the wheelchair's drive wheels, when drivably cradled between the two rollers, produces undesired drag, "scrubbing" the rubber from the tires while often providing an audible squeal. Scrubbing is thought to be caused by the circumstance that the wheelchair's drive wheels are generally set closer together at the top than at the bottom, a condition referred to as "camber". Scrubbing may be further increased if the rear drive wheels are additionally set so that they are closer together at the front than at the back (or closer together at the back than at the front), a condition known as "toe".

Trainers for three-wheel racer wheelchairs are known where scrubbing is substantially reduced. One such trainer includes a single roller for being driven by the racer wheelchair's two drive wheels, with the front wheel supported in place such that the centers of each of the drive wheels are directly vertically above the roller rotational axis. Another such prior art trainer, developed by the present inventors, utilizes two rollers of different diameters with their rotational axes parallel to one another and with the crest of each roller in the same horizontal plane. When used with a racer wheelchair, the wheelchair may be positioned such that its front wheel is supported in place with the centers of its drive wheels directly vertically above one or the other of the roller axes for driving the roller which is contacted by the drive wheels.

A second source of drag, however, is produced by the weight of the racer wheelchair and its user upon the driven roller. Although such drag may be acceptable for purposes of a workout, it hinders a computerized trainer's effectiveness in utilizing certain features such as permitting the racer wheelchair user to "race" against best racing times at various actual race tracks present in the computerized trainer's database. Also, in driving a racer wheelchair, it is usual for the user to hit the drive wheel hand rails downwardly with substantial force, which can break the tire's valve stem if the stem is in the vicinity of the roller when the hand rails are hit.

SUMMARY OF THE INVENTION

Drag produced by the weight of the racer wheelchair and its user upon the driven roller of a three-wheel racer wheelchair trainer, as well as the aforementioned problem of valve stem breakage, are substantially reduced or eliminated by the present trainer in which a jack is provided for supporting the wheelchair frame such that the drive wheels just make frictional driving contact with the trainer's driven roller.

Briefly described, the present invention provides a trainer apparatus for use with a racer wheelchair having two rear drive wheels and one front wheel mounted to a frame of the wheelchair, comprising the combination of: a trainer frame; a roller having a longitudinal axis and mounted to the trainer frame for being rotatably driven about the axis; a support carried by the trainer frame for holding the wheelchair front wheel such that the wheelchair drive wheels contact the roller for rotatably driving the roller with the center of each of the drive wheels directly vertically above the roller axis; and a jack carried by the trainer frame for supporting the wheelchair frame with the wheelchair drive wheels contacting the roller for decreasing the gravitational force exerted by the drive wheels on the roller. The support is horizontally adjustable perpendicular to the roller axis for adjusting position of the wheelchair front wheel such that the wheelchair drive wheels contact the roller with the center of each of the drive wheels directly vertically above the roller axis and the wheelchair frame is positioned for being supported by the jack.

The apparatus preferably includes a second roller having a longitudinal axis and mounted to the trainer frame for being rotatably driven about the second roller axis with the axes of the rollers parallel to one another. One of the rollers is heavier and is of greater diameter than the other of the rollers, and the crests of both rollers are in the same horizontal plane. The front wheel support is horizontally adjustable perpendicular to the roller axes for adjusting position of the wheelchair front wheel such that the wheelchair drive wheels contact the second roller with the center of each of the drive wheels directly vertically above the second roller axis and the wheelchair frame is positioned for not being supported by the jack.

A ramp is provided for accessing the wheelchair to the trainer frame such that the wheelchair front wheel is held by the support and the wheelchair drive wheels drivably contact a roller. Preferably, a load generator is coupled to the heavier roller for applying rotational resistance thereto, and a control module is provided for controlling the load generator.

BRIEF DESCRIPTION OF THE DRAWINGS

The novel features which are believed to be characteristic of the invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
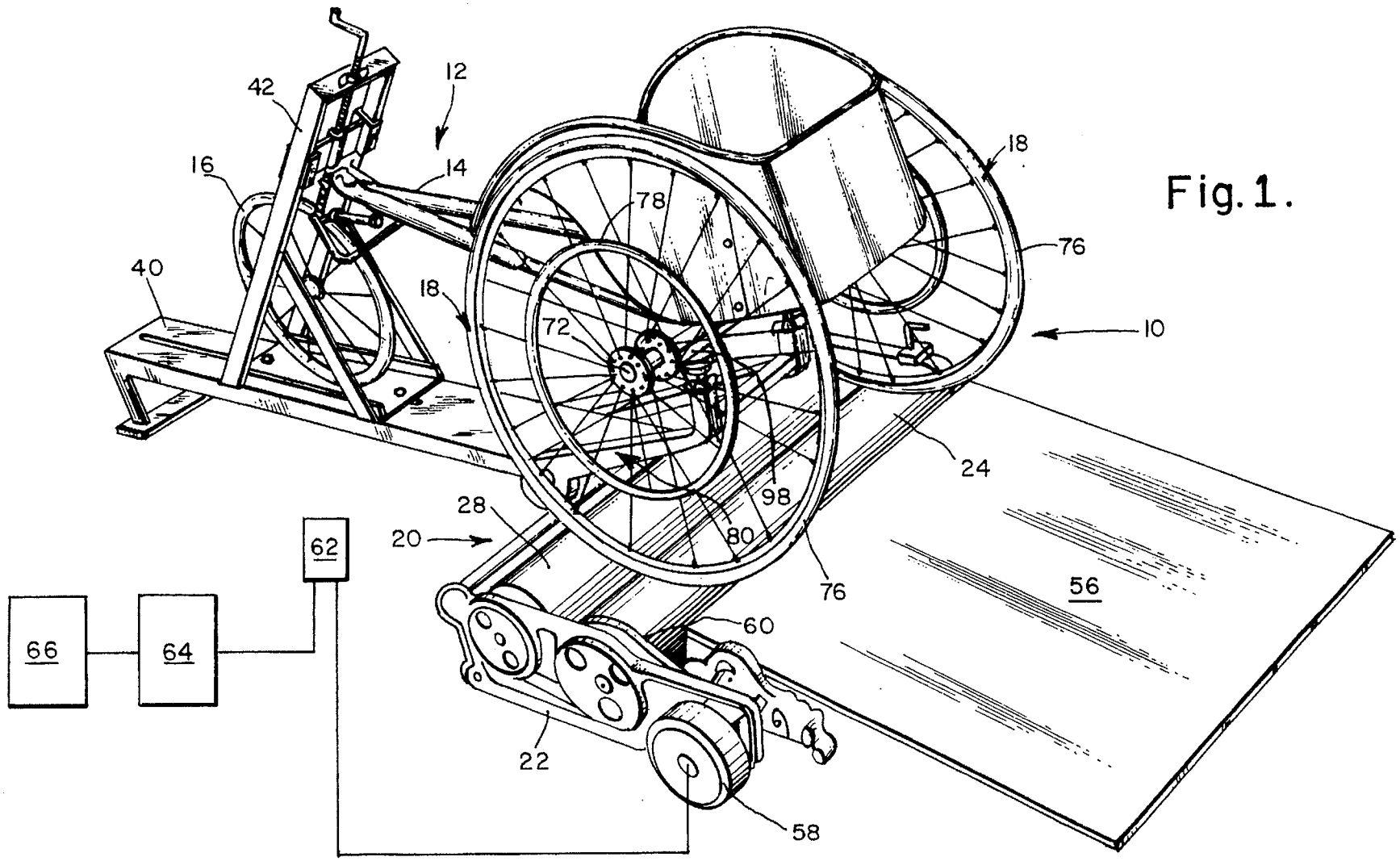
FIG. 1 is a rear side perspective view of a preferred embodiment of the wheelchair trainer according to the present invention, shown with a three-wheel racer wheelchair in place thereon.
Figure 4:
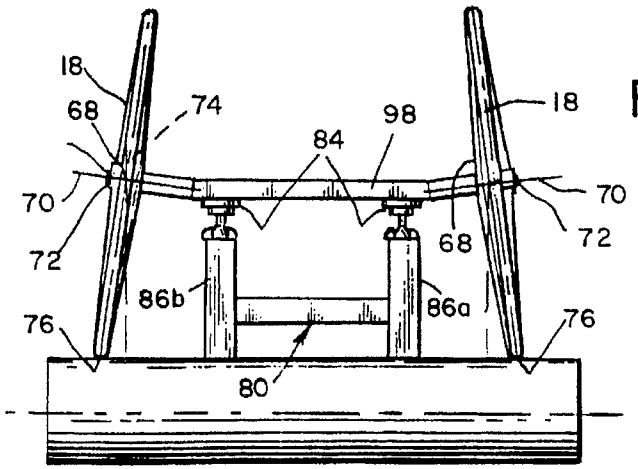
FIG. 4 is a partial rear elevation view of the apparatus of FIG. 3.

Turning first to FIG. 1, there is shown a preferred embodiment of wheelchair trainer apparatus 10 for use with a racer wheelchair 12 such as described in U.S. Pat. No. 5,333,894 to Mayes (incorporated herein by reference). The wheelchair 12 includes a structural frame 14, one wheel 16 mounted to the front of the wheelchair frame 14, and two large drive wheels 18 mounted to the rear of the wheelchair frame 14 and on either side thereof such that they exhibit a preselected camber as shown in FIG. 4 and may further exhibit a preselected toe.

Figure 2:
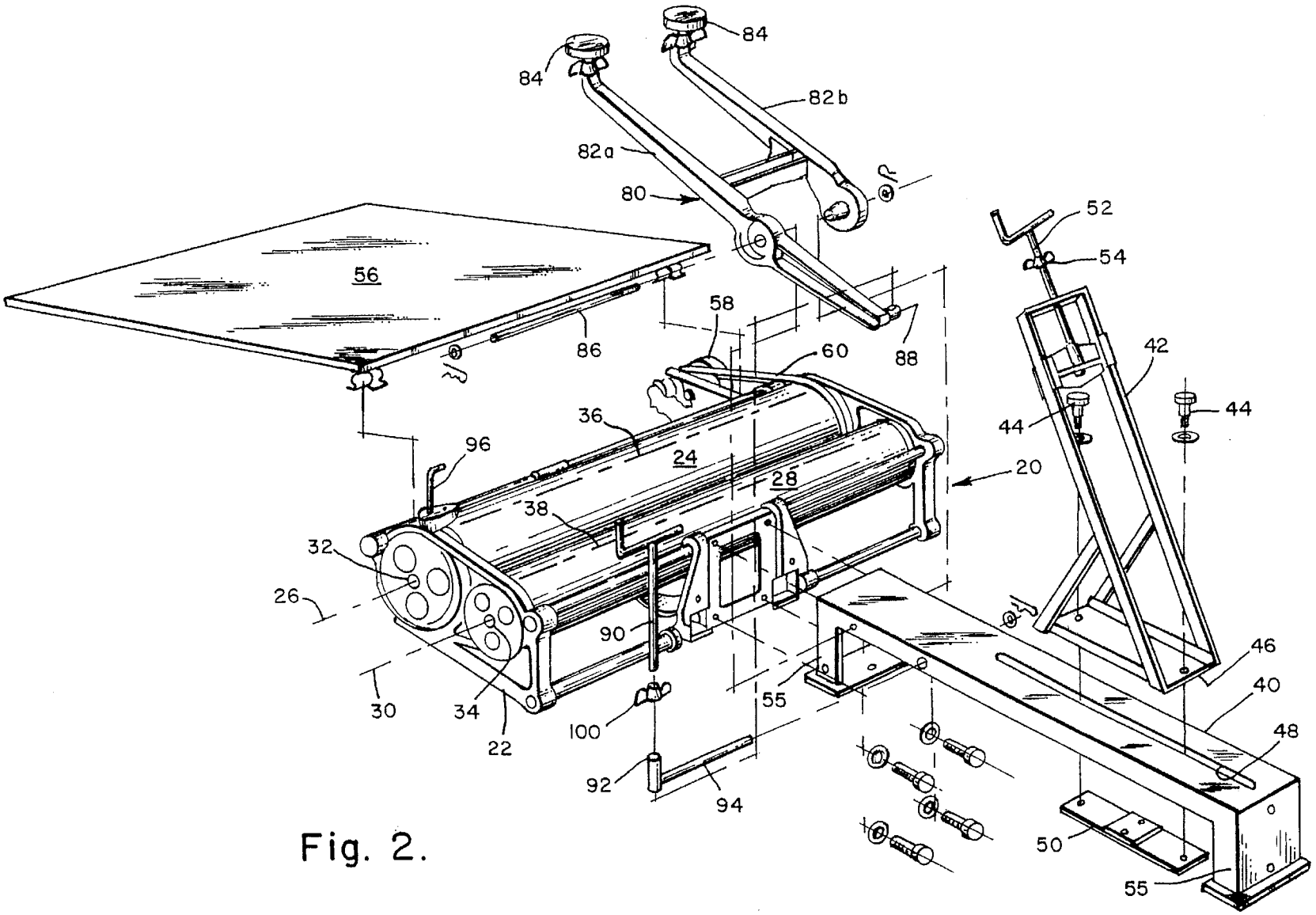
FIG. 2 is an exploded front side perspective view of the trainer of FIG. 1.
Figure 3:
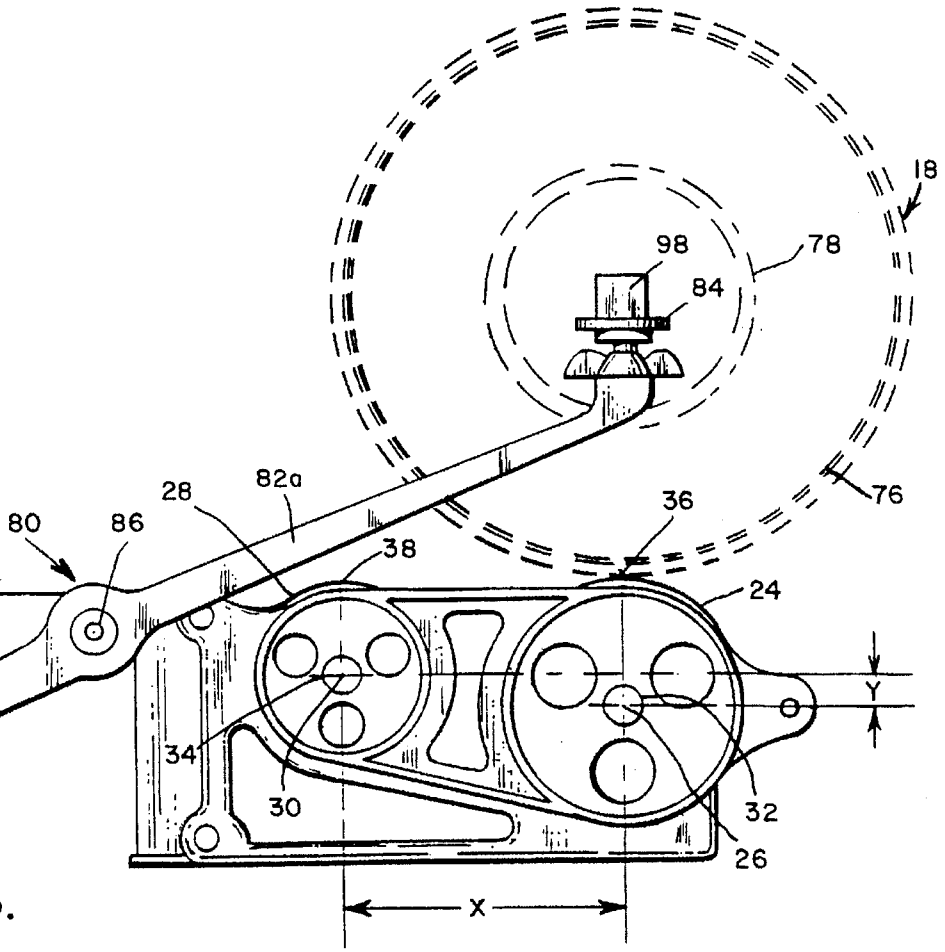
FIG. 3 is a partial side elevation view of the trainer of FIG. 1, shown with the wheelchair's rear drive wheels (in phantom) in place thereon.

Considering FIG. 2 along with FIG. 1, the trainer 10 includes a frame 20 including a subframe or roller mount 22. A first roller 24 having a longitudinal axis 26 and a second roller 28 having a longitudinal axis 30 are mounted to the roller mount 22 for rotation about their respective axes 26, 30. The rollers 24, 28 may be constructed of steel with aluminum end caps and with axles 32, 34 respectively along their longitudinal axes 26, 30 and rotatably mounted to the frame roller mount 22 by conventional means such as bearings. The first roller 24 is heavier and of a larger diameter than the second roller 28; the heavier roller 24 may be used for simulating road work and the lighter roller 28 may be used to work on hand speed and cardiovascular conditioning. In one example of such rollers, the outside diameters of the first and second rollers 24, 28 were 6⅝ inches and 5 inches, respectively. The roller axes 26, 30 are parallel to each other and (as best shown in FIG. 3) are horizontally spaced apart by a predetermined distance x. The roller axes 26, 30 are vertically spaced apart by a distance y (FIG. 3) such that the crests 36, 38 (FIGS. 2 and 3) of both rollers 24, 28 (i.e. the upper horizontal tangents to the circumferences of the rollers 24, 28) lie in substantially the same or a common horizontal plane.

The trainer frame 20 further includes a rail 40 secured to the roller mount 22, approximately centered between the ends of the rollers 24, 28 and extending horizontally perpendicular to the roller axes 26, 30. A wheel chock 42, for holding the wheelchair's front wheel 16, is adjustably secured to the rail 40 for movement therealong, such as by bolts 44 extending through the chock's bottom plate 46 and a longitudinal slot 48 along the rail 40 and threadably secured to a locking bar 50. The front wheel chock 42 may therefore be fixably secured along the rail 40 at any position which may be accommodated by the length of the slot 48. The length of the slot 48 with respect to the roller mount 22 is such that the wheelchair 12 may be supported with its front wheel 16 held by the chock 42 in a first position where the wheelchair's rear wheels 18 are drivably positioned in contact with the first roller 24, and the chock 42 may be positionally adjusted, at least by the aforementioned horizontal predetermined distance x, for holding the wheelchair's front wheel 16 in a second position where the rear wheels 18 are drivably contacting the second roller 28.

The front wheel chock 42 includes a hold down crank screw 52 with locking wing nut 54, for securing the wheelchair's front wheel 16 to the chock 42 for being positionally supported on the rail 40. The rail includes legs 55, which are preferably of a height for maintaining the wheelchair 12 in a substantially horizontal position when the wheelchair 12 is positioned on trainer 10 for driving either of the rollers 24, 28, i.e. the bottom of the front wheel 16 is in the same horizontal plane as the crests 36, 38 of the first and second rollers 24, 28. An inclined plate or ramp 56 is secured to the roller mount 22 for permitting the wheelchair 12 access to the rollers 24, 28 and the front wheel 16 to the rail-supported front wheel chock 42. The front wheel chock 42 is tilted toward the wheelchair user, for placing the hold down crank 52 and wing nut 54 within easy reach of the user.

As represented in FIGS. 1, 3 and 4, the wheelchair 12 is positioned on the trainer 10 such that the center 68 of each drive wheel (see FIG. 4) is directly vertically above the longitudinal axis 26 of the roller 24. The center 68 of each wheel 18 is located at the intersection of the rotational axis 70 of the wheel's axle 72 and the wheel diameter 74, and the wheelchair 12 is positioned with the wheel centers 68 directly vertically above the axle 32 of the roller 24 so that the tire 76 of each of the drive wheels 18 contacts the crest 36 of the roller 24. In a usual circumstance where the wheel exhibits camber (as shown in FIG. 4), and perhaps no toe, the rotational axis 70 of each of the drive wheels 18 is aligned directly above the rotational axis 26 of the roller 24, i.e. the wheel axes 70 and the roller axis 26 are in a common or the same vertical plane. Accordingly, the wheelchair 12 may be positioned with the drive wheels' 76 contacting or drivably engaging the roller 24 and with (as viewed from the side) the end of each drive wheel axle 72 directly vertically above the end of the roller axle 32. For a particular wheelchair, the front wheel chock 42 is positionally adjusted and locked along the rail 40 such that the wheelchair's drive wheels 18 are correctly positioned on the roller 24 (or alternatively on the roller 28), with the drive wheel centers 68 directly vertically above the longitudinal axis 26 of the first roller 24 (or alternatively directly vertically above the longitudinal axis 30 of the second roller 28).

According to the present invention, the trainer 10 includes a jack 80 for exerting an upward force upon and supporting the wheelchair frame 14 such that the drive wheels 18 just make frictional driving contact with the roller 24. As best shown in FIGS. 2 and 3, the jack 80 includes two arms **82*a*, 82*b* with associated jack pads 84 at one of their ends, pivotable about a horizontal shaft 86 perpendicularly secured to the rail 40. One of the pivot arms 82*a* includes a cup 88 at its other end, for receiving the lower end of a vertically disposed crank screw 90 through a threaded sleeve 92 secured to a horizontal shaft 94 perpendicularly and rotationally secured to the rail 40**.

In use, the wheelchair 12 is forwardly driven up the ramp 56 and onto the trainer 10, the user having first locked the first roller 24 against rotation by means of the roller lock pin 96. The front wheel 16 is driven into the front wheel chock 42 and the user thereupon turns the hold down crank 52 and tightens the wing nut 54 for holding the front wheel 16 in place. The position of the front wheel chock 42 had previously been set along the rail 40 such that the wheelchair's drive wheels 18 are correctly positioned on one of the rollers 24, 28.

When the drive wheels 18 are positioned on the first roller 24, a portion of the wheelchair frame 14, such as a horizontal bar 98 connecting the wheelchair's two drive wheel axles 72, is situated directly above the jack pads 84. The user thereupon turns the crank shaft 90 to pivot the jack arms 82 for raising the jack pads 84 until the pads 84 contact the wheelchair frame bar 98. After the roller 24 is unlocked by releasing the lock pin 96, the user adjusts the jack 80 for increasing upward force on the wheelchair frame bar 98 for supporting most of the weight of the chair and user upon the roller 24, i.e. for decreasing the gravitational force exerted by the drive wheels 18 on the roller 24, while still permitting sufficient driving friction between the drive wheel's tires 76 and the roller 24. Such adjustment may be performed by the user's adjusting the hand crank 90 while driving the drive wheels 18 until this condition has been implemented. At this point, the jack crank shaft 90 is locked by tightening the wing nut 100.

When the wheelchair drive wheels 18 are positioned on the trainer 10 such that its drive wheels 18 are in driving contact with the second roller 28, the wheelchair frame's horizontal bar 98 is positioned for not being supported by the jack 80.

By use of the jack 80 in accordance with the present invention, the deleterious effects of the weight of the racer wheelchair 12 and its user upon the contact areas of the drive wheel tires 76 with the first roller 24, are substantially decreased or virtually eliminated. As a result, the trainer 10 has the ability to simulate real road conditions, providing the wheelchair user with a more realistic "feel of the road" and enhancing the trainer's effectiveness when used with interactive computer aids. Further, the likelihood of impact-induced tire valve stem breakage, especially when the user forcefully hits the wheelchair hand rails 78 downwardly when a valve stem is directly above the contact area of a tire 76 with the first roller 24, is greatly reduced by use of the jack 80.

The racer wheelchair trainer 10 preferably includes a resistance device or load generator 58 for applying resistance against rotation to the roller 24. In one example, the load generator 58 was an eddy current brake (such as distributed by RacerMate, of Seattle, Wash., under the designation R-983-006-00) driven by the roller 24 through a drive belt 60, with the amount of load or resistance controlled by a microprocessor-based control module 62 which can be hand held or mounted to the wheelchair 12 or to the trainer 10 in a location convenient to the wheelchair user. The user may set the control module 62 at a desired workload level, for operating the trainer as a wheelchair ergometer. The control module 62 may be of a type such as distributed by RacerMate, of Seattle, Wash., under the designation R-983-009-00, and used by RacerMate in its CompuTrainer computer aided bicycle trainer Model 8000.

By interfacing the controller 62 to an interactive video game system 64, such as an 8-bit Nintendo® Entertainment System using software programs with a database for simulating real road racing conditions at various race tracks, the trainer 10 may be used for permitting the wheelchair user to compete with a computer racer or with one of the user's own previous performances, with the trainer 10 simulating effects of road grade, wind, rider weight and drafting while also providing training statistics such as speed, distance, power, elapsed time and heart rate (when used with a heart rate sensor). A video display 66 may be used for showing two wheelchair racers, and two trainers 10 may be connected to a single game system 64 for two person head-to-head races, or if a single trainer 10 is connected then the other competitor imaged on the video display 66 may be either a computer racer or a playback of the user's own previous performance.

Thus there has been shown a wheelchair trainer apparatus for use with a three-wheel racer wheelchair. A jack supports the wheelchair frame such that the drive wheels just make frictional driving contact with the crest of one of the two of the trainer's rollers. Undesired drag, caused by the weight of the user and the wheelchair, is substantially decreased or eliminated by the present trainer, enhancing the trainer's ability to simulate real road conditions for more effective utilization of computer aids. Other embodiments of the present invention and modifications of the embodiments herein presented may be developed without departing from the essential characteristics thereof. Accordingly, the invention should be limited only by the scope of the claims listed below.

We claim:

1. Wheelchair trainer apparatus comprising the combination of:

a racer wheelchair having two rear drive wheels and one front wheel mounted to a wheelchair frame;

a trainer frame;

a roller having a longitudinal axis and mounted to said trainer frame for being rotatably driven about said axis;

a front wheel support carried by said trainer frame for holding said front wheel of said wheelchair such that said drive wheels contact said roller for rotatably driving said roller with the center of each of said drive wheels directly vertically above said roller axis; and a jack carried by said trainer frame and operable by a user of said wheelchair when said wheelchair is positioned on said trainer frame with said front wheel held by said front wheel support and said drive wheels contacting said roller, for contacting said wheelchair frame and for exerting an upward force upon said wheelchair frame such that said wheelchair and the user are supported with said drive wheels just making frictional driving contact with said roller.

2. The apparatus according to claim 1, further including:

a ramp for accessing said wheelchair to said trainer frame such that said front wheel is held by said front wheel support and said drive wheels contact said roller for rotatably driving said roller.

3. The apparatus according to claim 1, further including:

a load generator coupled to said roller for applying rotational resistance to said roller; and a control module for controlling said load generator.

4. The apparatus according to claim 1, wherein:

said front wheel support is horizontally adjustable perpendicular to said axis of said roller for adjusting position of said front wheel such that said drive wheels contact said roller with the center of each of said drive wheels directly vertically above said roller axis and said wheelchair frame is positioned for being supported by said jack.

5. The apparatus according to claim 4, further including:

a second roller having a longitudinal axis and mounted to said trainer frame for being rotatably driven about said axis of said second roller and with said axes of said rollers parallel to one another.

6. The apparatus according to claim 5, wherein:

said front wheel support is horizontally adjustable perpendicular to said axis of said second roller for adjusting position of said front wheel such that said drive wheels contact said second roller with the center of each of said drive wheels directly vertically above said axis of said second roller and said wheelchair frame is positioned for not being supported by said jack.

7. The apparatus according to claim 6, wherein:

one of said rollers is heavier than the other of said rollers.

8. The apparatus according to claim 6, wherein:

the diameter of said second roller is less than the diameter of the first of said rollers and the crests of said rollers are in the same horizontal plane.

9. The apparatus according to claim 8, further including:

a load generator coupled to said first of said rollers for applying rotational resistance thereto; and a control module for controlling said load generator.

10. The trainer apparatus according to claim 1, wherein:

said wheelchair frame includes a bar connecting the axles of said drive wheels; and said jack includes pads situated such that said bar is directly above said pads when said wheelchair is positioned on said trainer frame with said front wheel held by said front wheel support, said jack including means operable by the user for raising said pads to contact said bar and for exerting said upward force on said bar.

* * * * *

UNITED STATES PATENT AND TRADEMARK OFFICE

CERTIFICATE OF CORRECTION

PATENT NO : 5,649,883

DATED : July 22, 1997

INVENTOR(S) : Douglas Mayes and Jerome M. Burak

It is certified that error appears in the above-identified patent and that said Letters Patent is hereby corrected as shown below:

Item [56],

On the title page, in the "References Cited" section, under "U.S. PATENT DOCUMENTS", the following additional references should be inserted:

| | | |
|---|---|---|
| --2,805,860 | 9/1957 | Littig |
| 3,866,908 | 2/1975 | Hangler |
| 4,932,651 | 6/1990 | Defaux |
| 4,969,642 | 11/1990 | Phillips |
| 5,476,429 | 12/1995 | Bigelow et al.-- |

On the title page, in the "References Cited" section, under "OTHER PUBLICATIONS", in the Freeman reference, "V.29" should be --V.20--

In Column 4, line 23, --tires-- should be inserted after "wheels'"

Signed and Sealed this

Twenty-first Day of October 1997

*Attest:*

*Attesting Officer*

BRUCE LEHMAN

*Commissioner of Patents and Trademarks*